United States Patent [19]

Roge et al.

[11] Patent Number: 4,711,391

[45] Date of Patent: Dec. 8, 1987

[54] MAILBOX SIGNAL DEVICE

[76] Inventors: Paul Roge, 8 S. 510 River Dr., Naperville, Ill. 60565; Ralph R. Roge, 6426 S. Richmond, Claredon Hills, Ill. 60514

[21] Appl. No.: 14,686

[22] Filed: Feb. 13, 1987

[51] Int. Cl.[4] ..... A47G 29/12

[52] U.S. Cl. ..... 232/35; 232/17

[58] Field of Search ..... 232/17, 34, 35

[56] References Cited

U.S. PATENT DOCUMENTS

| | | | |
|---|---|---|---|
| 2,428,423 | 10/1947 | Hurban | 232/35 X |
| 2,433,940 | 1/1948 | Weaver | 232/35 |
| 3,482,543 | 12/1969 | Guidos | 232/35 |
| 3,866,823 | 2/1975 | Grayson | 232/35 |
| 4,000,847 | 1/1977 | Duis | 232/35 |
| 4,524,905 | 6/1985 | Crist | 232/17 X |

*Primary Examiner*—Robert W. Gibson, Jr.
*Attorney, Agent, or Firm*—Charles F. Lind

[57] ABSTRACT

The disclosed signal device has a base plate and a signal plate, each plate having a threaded member secured relative thereto. A helical coil spring is threaded onto the respective threaded members, to become fixed between said base and signal plates. The signal plate has adjacent an edge remote from the spring, a tab portion angled about an axis disposed transverse to the threaded member. A double sided adhesive tape, bonded on one side to the face of the base plate remote from said spring, has the other side on the base plate, but it is yet covered by a removable facing. After removing the tape facing, the base plate may be positioned with the adhesive side against the exterior wall structure of a roadside mailbox, at a suitable spacing from the adjacent open end and door of the mailbox. Thus, when positioned, the signal plate and tab may be moved according to the flex of the spring, to a lowered position where the tab may be locked adjacent the closed door of the mailbox, to hold the signal plate set in the lowered position. The signal plate tab, upon said door being opened, is released to allow the signal plate to be moved automatically by the flexure of the spring to an elevated position upstanding from the mailbox, to be visible from afar. The elevated signal flag may advise that the mail carrier has deposited mail in the mailbox.

9 Claims, 11 Drawing Figures

10
44
40
42
3
3
54

56
44
40
28
10
12
46
44
26
42
256
144
260
289
291
54
32
34
24
18
20

56
260
289
291

18
46
40
44
54
42
10
56
14
18
16
24

FIG. 5
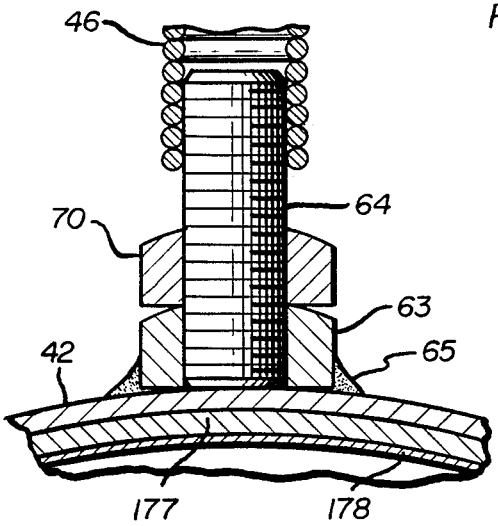
FIG. 6
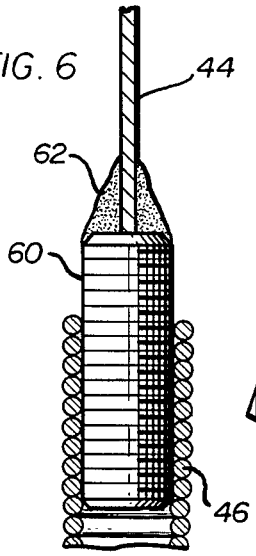
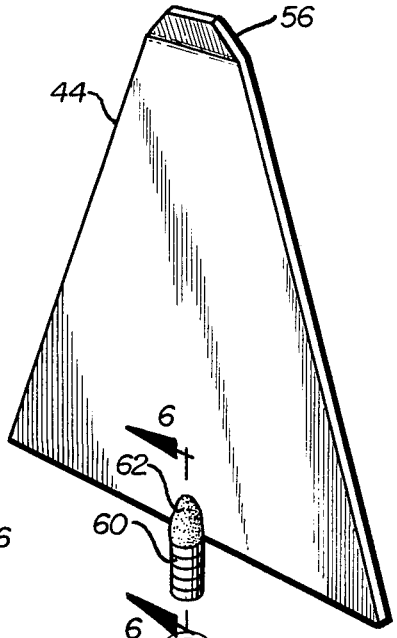
FIG. 4
FIG. 7
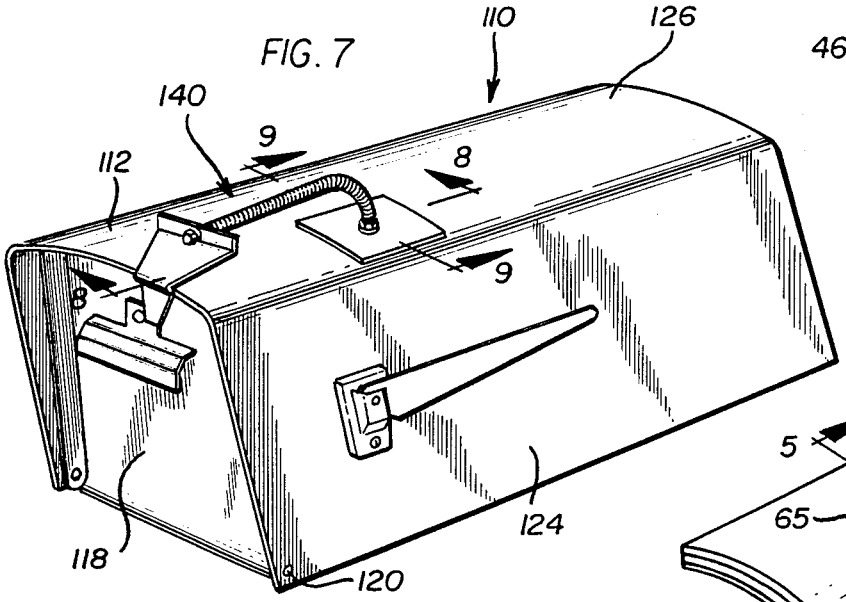
FIG. 9
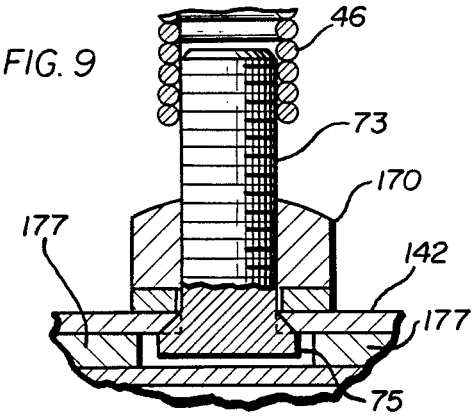
FIG. 8
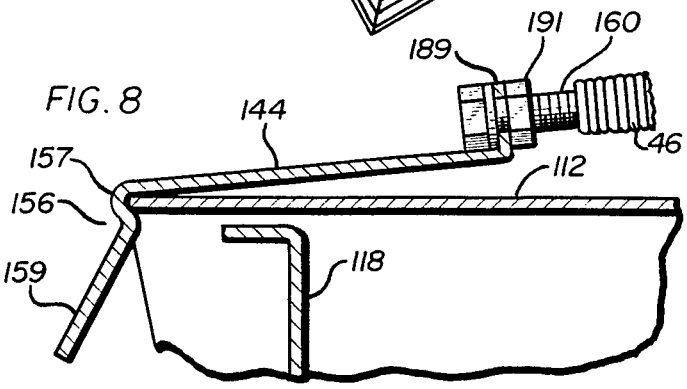

MAILBOX SIGNAL DEVICE

FIELD OF THE INVENTION

This invention relates to a roadside type mailbox having a front opening and a hinged door for closing the opening, and specifically, to a signal device adapted to be mounted on such a mailbox, capable of shifting automatically to a visible upright position, when the door is opened, to alert someone that the door has been opened, such as by the mail carrier in depositing mail into the box, even though the door has subsequently been reclosed.

BACKGROUND OF THE INVENTION

Mailboxes of the type associated with rural delivery addresses, may be located next to the side of a road, so that the mail can be delivered to such boxes by means of a motor vehicle . . . typically without the mail carrier even getting out of the vehicle. The roadside mailbox is generally thus some distance from the quarters actually intended for the mail. With unpredictable schedules of even mail carriers, it is not uncommon for someone to walk to a distant mailbox . . . only to find it empty . . . because the mail had not yet been delivered that day.

Devices may be used on roadside mailboxes, to signal when the mailbox door has been opened. Such devices frequently may use a flag that normally upstands from the mailbox, held there resiliently by a spring or a counterbalance; but the flag may be shifted to a lowered position, against the force of the spring or counterbalance. Some form of catch may be used to hold the flag lowered, being triggered by the door being opened to release the flag to the upright position.

Many of such known signal devices typically may not be easily mounted on the mailbox, without using tools, or without irreversibly altering the mailbox... such as by drilling mounting holes in it. Moreover, once in place on the mailbox, many such signal devices may require that two hands be used to lower and set the flag, such as possible upon simultaneously closing the mailbox door. Also, many signal devices, when mounted on the mailbox, face toward the front of the mailbox, to provide only a partical profile of the signal flag from any side angle of viewing, such as may be required if the mailbox is to be viewed from the intended quarters.

The following identified U.S. Patents illustrate different forms of mailbox signal devices, including U.S. Pat. No. 2,433,940 issued to H. M. Weaver; U.S. Pat. No. 2,874,895 issued to F. W. Opp et al; U.S. Pat. No. 3,490,411 issued to M. C. Poindexter; U.S. Pat. No. 3,596,631 issued to D. F. Sutton; U.S. Pat. No. 3,866,823 issued to R. E. Grayson; U.S. Pat. No. 4,000,847 issued to J. L. Duls; and U.S. Pat. No. 4,138,056 issued to J. T. Sherrill.

SUMMARY OF THE INVENTION

The present invention provides a signal device that may be mounted on a roadside type mailbox without tools and without physcially marring the mailbox and its normal operation. The device, when mounted on the mailbox, may be adjusted to provide full viewing of the elevated signal flag, from any desired direction (not being restricted to facing the front of the mailbox) for good directional visibility. The device may be set with only one hand, after the mailbox door has been closed, such as after picking up the mail just delivered and while holding it in the other hand. The device is automatically released from the lowered set position upon the mailbox door being opened, to an elevated position upstanding from the mailbox, to be visible from afar.

The signal device has a base plate and a signal plate, and a helical coil spring connected between these plates, to resiliently hold them together. The face of the base plate remote from the spring is adapted to cooperate with wall structure of the mailbox; and adhesive means on such remote face, exposed upon removing a protective cover facing, is adapted to secure said base plate to the wall structure at a specific location. At such specific location, the signal plate may be moved, against the flex of the spring, to a lowered position adjacent the open end of the mailbox. A tab is formed off of said signal plate adjacent an edge remote from the spring, said tab being angled from the signal plate about an axis disposed transverse to the spring. The tab may be interlocked with the mailbox wall structure and/or door, to retain the signal plate in the lowered set position. Exposed threaded members are secured to the base and flag plates, to allow the spring to be threaded onto the threaded members and provide the connection between the plates and spring. A lock nut at either threaded connection, allows rotational adjustment of the base and flag plates, for providing maximum exposed area of the adjusted flag plate from any selected angle of viewing relative to the front of the mailbox.

BRIEF DISCRIPTION OF THE DRAWINGS

FIG. 4 is an exploded perspective view of the signal device of FIGS. 1–3, by itself;

Figures 1, 2, 3, 10:
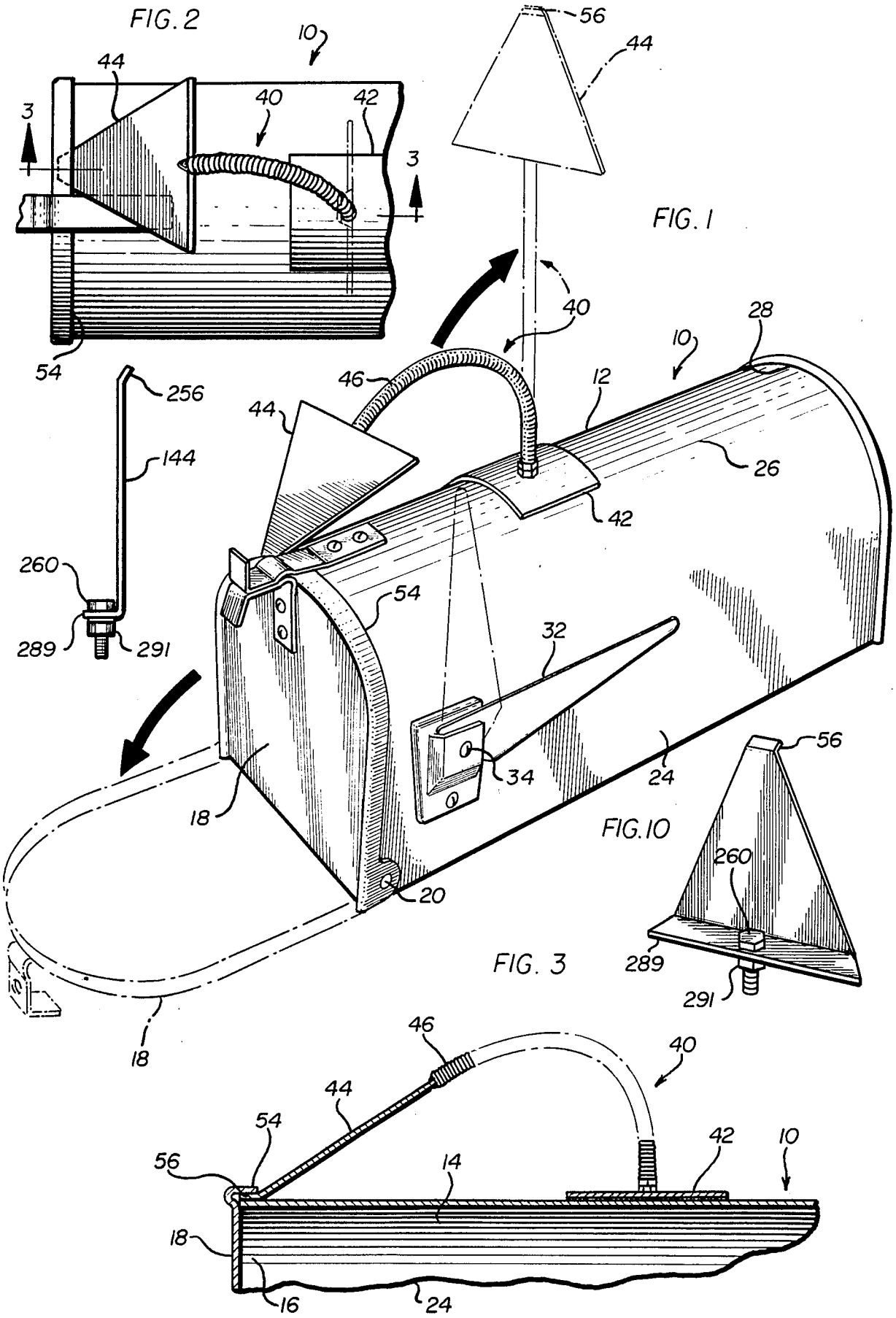
FIG. 1 is a perspective view of one standard form of roadside mailbox, showing a first embodiment of signal device mounted thereon.
FIG. 2 is a top plan view of part of the mailbox and the signal evice of FIG. 1.
FIG. 3 is a sectional view, as seen generally from line 3—3 in FIG. 2.

FIGS. 5 and 6 are enlarged fragmentary sectional views, as seen respectively from lines 5—5 and 6—6 in FIG. 4, except showing the components in assemblied relationship together;

FIG. 7 is a perspective view of a second standard form of a roadside mailbox, showing a second embodiment of the signal device mounted thereon;

FIG. 8 is a sectional view of part of the mailbox and signal device, as seen from line 8—8 in FIG. 7;

FIG. 9 is an enlarged fragmentary sectional view, as taken generally from line 9—9 in FIG. 7;

FIG. 10 is a perspective view of modified signal device, having a flag of the type used with the mailbox of FIGS. 1–3; and FIG. 11 is an end elevational view of the signal device of FIG. 10.

DETAILED DESCRIPTION OF ILLUSTRATED EMBODIMENTS

FIG. 1 shows one conventional roadside type mailbox 10, which may have wall structure 12 defining an enclosure 14 open at one end 16, and a door 18 hinged by pins 20 to the wall structure 12 to be moved between a closed position (illustrated in solid in FIG. 1) across said end 16, and an opened position (illustrated in phantom in FIG. 1) providing access into and from the box enclosure 14. The mailbox wall structure 12 includes opposing sides 24, and an upper portion 26 common with the sides 24 and curved across the top of the enclosure 14. The sides 24 and curved upper portion 26 are connected at 28 to a rear wall (not shown) to close that end of the mailbox enclosure 14.

An indicator flag 32 will typically be hinged by pin 34 to one side of the maibox 10, capable of being shifted from the lower position (illustrated in solid in FIG. 1) to an elevated or vertical position (illustrated in phantom in FIG. 1). When raised, the indicator flag 32 is used to signal the mail carrier to stop at the mailbox and pick up something intentionally left therein. This indicator device 32 is not of any concern to the invention to be disclosed herein; but the invention is to be applied to the mailbox 10 in addition to any such device.

The signal device 40 of this invention has a base plate 42 and a flag plate 44; and a coil tension spring 46 secured adjacent its opposite ends relative to these plates. The flag plate 44 is of a generally triangular shape, mounted with one edge adjacent the spring 44 and with the two other edges converging upwardly from the base edge to an upper corner remote from the spring 46.

The base plate 42 is adapted to be fixed to the mailbox, with its face remote from the spring 46 fitted flush against the exterior of the wall structure. In the relaxed position of the signal device 40, the spring 46 extends somewhat vertically, to hold the flag 44 raised in a visible position above the mailbox 10. The base plate will be spaced from the door end of the mailbox, at a location to allow the signal flag 44 to be moved laterally and downwardly, according to the displacement of the spring as laterally flexed or bowed, to a lowered position, where its upper corner is adjacent the open end 16 of the mailbox 10.

In the mailbox 10 illustrated in FIGS. 1–3, the mailbox door 18 has a flange 54 that overlaps the end periphery of the mailbox wall structure 12, adjacent the open end 16 of the mailbox; and the overlapped flange 54 and mailbox wall structure define a small clearance gap between. A tab 56 is formed at the upper flag plate corner, bent slightly, possibly between 20 and 40 degrees, relative to the flag plate. When the door 18 is closed and the flag plate 44 is lowered, the tab 56 is adapted to be fitted into the clearance gap between the flange 54 of the closed door 18 and mailbox wall structure 12; and to extend substantially parallel to each.

The flag plate 44, in this set position will be angled upwardly from the mailbox wall structure the same angle the tab is angled from the flag plate, or between approximately between 20 and 40 degrees. The upward force of the flexed spring 46 on the flag plate 44 binds the tab 56 sufficiently relative to the door flange 54 and wall structure 12, to hold the flag in the set lowered spring-flexed position. A tab of the order of between ¼ and ½ of an inch long will generally be adequate.

When the mailbox door 18 is opened, the door flange 54 is moved away from the wall structure 12, to release the tab 56 automatically and allow the spring 46 to raise the display flag 44 to its elevated position.

As the upper portion 26 of the mailbox wall structure 12 is curved somewhat as a partical cylinder, the base plate 42 is correspondingly shaped to complement this curved upper portion. Thus, the base plate 42 is straight along a first axis, and is curved somewhat as a partical cylinder along another axis at right angles to the first axis. The curved base plate 42 thus is adapted to fit flush against the curved top 26 of the mailbox 10, with the curved portion extended in line between the open front end 16 and closed rear end 28 of the mailbox.

To connect the spring 46 to the flag plate 44, a threaded stud member 60 is secured to the flag plate near its lower side edge, opposite from the tab 56, and such member 60 projects a slight distance from the flag plate. The member 60 illustrated has a cross slot therein to receive the flag plate 44; and the member and plate components, as so positioned, may be then welded, brazed or bonded together, as at 62. The exposed end of the stud member 60 is adapted to be threaded into the upper open end of the helical spring 46.

To connect the spring 46 to the base plate 42, a nut 63 is secured to the base plate, being welded, brazed or bonded thereto, as at 65; and presents a threaded tap. A threaded stud member 64 is threaded into the open lower end of the spring 46; and the lower exposed portion of the stud member is threaded into a threaded base plate tap of the nut 63.

The indicator flag plate 44 may be rotatably adjusted, while mounted on the mailbox 10 to face toward, and thereby maximize its exposed area to be particularly visible from, any certain angle of viewing relative to the open front end 16 of the mailbox. Thus, lock nut 70 is threaded onto the member 64 beyond the lower end of the spring 46, while yet leaving enough of the threaded member 64 to be threaded into the base plate tap. As such, the member 64 is threaded into the base plate tap to any rotational orientation selected for the signal flag plate 44; and the nut 70 is then tightened against the base plate nut 63 to lock the components nonrotatably together, at such adjusted orientation.

The threaded members 60 and 64 may have approximately the same O.D. and pitch, as the spring I.D. and helix angle of the adjacent spring turns, to allow the spring and threaded members to be threaded together. After only a few spring turns overlap on the threaded members, the spring becomes securely fixed relative to said members. The illustrated right-hand threads and spring turns, provide that the separate components can be easily rotated relative to one another to tighten them together; but they cannot be easily rotated in the opposite direction to unthread them, as any such attempted rotation tightens the spring turns down onto the threaded member, to prevent such rotation.

FIG. 9 illustrates an alternative arrangement, using a cam bolt 73 fitted through an opening in the base plate 142, with the bolt head 75 on the plate underside. The bolt head 75 is serrated, to become nonrotatably stacked to the base plate 142 on its underside, as the nut 170 is drawn down tightly to force the serration into the base plate itself. As secured, the bolt end exposed above the nut 170 may be threaded into the lower open end of the spring 46. In a preferred mode of operation, the angular orientation of the flag plate may first be set to that desired for full viewing, before the nut is tightened down completely.

In FIGS. 7 and 8, an alternate form of mailbox 110 is illustrated, having a slightly bowed but generally flat upper wall structure 126 connected between generally vertical sides 124; and the sides 124 and upper portion 126 of the mailbox wall structure 112 overhang the closed mailbox door 118. The closed mailbox door 118 thus will be on the underside of the wall structure 112, opposite from the signal device 140, which is on the upper side. For this type of mailbox, the flag tab 156 has a hook portion 157 angled approximately at right angles relative to the flag plate 144 and extended therefrom a distance between ¼ and ½ of an inch; and also has a cam portion 159 angled at sightly less than right angles relative to the hook portion 157 and extended a distance between ½ inch and 2 inches.

The hook portion 157 is adapted to be fitted over the end edge of the mailbox wall structure 112, after the mailbox door 188 has been closed, to hold the flag plate 144 in the lowered position. In this lowered position, the cam portion projects downwardly beyond the door, as it will arc in pivoting about the mounting pins 120. Thus, when the door 118 is opened, the door engages the cam portion 159 and thereby disengages the hook 157 from the mailbox structure 112 and release the signal flag plate 144 automatically.

As also illustrated in this embodiment, the base plate 142 may be flat to fit flush against the generally flat upper portion 126 of the wall structure 112.

A double sided adhesive 177 may be secured on one side, by the manufacturer of the flag device, to the base plate 42 (and 142); while the other outer side of the adhesive may yet remain covered with the removable facing 178. Upon the installer of the signal device 40 (or 140) removing the facing 178, the adhesive 177 is exposed, adapted to allow the base plate 42 (or 142) to be bonded securely to the mailbox wall structure. The adhesive may be in the form of a double sided tape, and the facing 178 may be removed when the base plate is to be secured to the mailbox. The adhesive 177 may thus secure the base plate to the wall structure, for quick installation of the signal device onto a mailbox, without the use of tools and/or without drilling any mounting holes or the like in the mailbox, which would alter it permanently.

The base plate 42 (and 142) may be sized between 2 and 4 inches, extended in the front-to-rear direction of the mailbox, when so mounted thereon; and between 1 and 3 inches in the lateral direction. This provides sufficient bonding area for most types of mailboxes. Of interest also, the adhesive 177 may be of a thickness between 0.01 and 0.1 inches, again to be adequate to bond the base plate to mailbox surfaces of various degrees of smoothness. In this regard, such mailbox wall structures may be smooth, or they may be wavy, consisting of small adjacent ribbings for added mailbox strength and durability.

An alternative manner of providing a plate-threaded member connection is illustrated in FIGS. 10 and 11. In this embodiment, a lower end lip 289 of the flag plate 244 is bent over at substantially right angles to the remainder of the flag plate; and a headed bolt 260 is fitted from above through an opening in the edge lip 289. A nut 291 may be threaded onto the bolt 260 on the underside of the lip 289, and the yet exposed end of the bolt may be threaded into the upper end of the spring. The tab 56 is angled off of the flag plate 244 on the side opposite the bolt 260. When the nut 291 is loosened somewhat, the rotational alignment of the flag plate 244 may be set, whereupon the nut may be tightened to provide for the angular adjustment of the flag plate relative to front open end of the mailbox.

The spring 46 may be between 3 and 6 inches long, having a coil diameter between ¼ and ½ inch, having a wire diameter between 0.02 and 0.06 inches, and having touching adjacent turns. The flag plate may be generally flat, and between 3 and 6 inches on edge, as a somewhat eguilateral triangular; or of another shape of roughly the same breadth and area.

Also, when the flag plate 44, 144 or 244 is adjusted to face some direction other than the front of the mailbox, for maximum directional visibility, the tab 56 or the hook portion 157 likewise will be angled in the same direction. The torsional flexibility of the spring allows the tab or hook portion to be rotated relative to the base plate, in order to be squared relative to the front end of the mailbox, when the flag plate is in the operative lowered position. However, when the spring is released to the elevated position, it will rotate to its nonstressed orientation, to return the flag plate to its rotatably adjusted orientation.

While specific embodiments have been disclosed herein to illustrate the invention, it will be apparent that modifications may be made therefrom without departing from the inventive concept. Accordingly, it is intended that the invention be limited only by the scope of the following claims.

What we claim as our invention is:

1. For use on a roadside mailbox having wall structure defining an enclosure open at one end and a door hinged to the wall structure to be moved between closed and opened positions relative to the open end, a signal device comprising the combination of a base plate and a signal plate;

threaded means secured to each plate, each having an exposed end;

a helical coil spring, and said spring being threaded onto the exposed ends of the threaded means, for securing the base and signal plates resiliently together;

a tab formed off of said signal plate adjacent an edge remote from the spring, said tab being angled from the signal plate about an axis disposed transverse to the spring;

said base plate being adapted to be positioned with one face flush against the mailbox wall structure, at a location where the signal plate tab may be moved, against the flex of the spring, to a lowered position adjacent the open end of the mailbox, to be operatively held so lowered; and adhesive means on said base plate face, adapted to secure said base plate to the wall structure at said location;

whereby said tab may be released from said lowered position automatically upon the door being opened, and said signal plate being resiliently moved to an elevated position upstanding from the base plate and wall structure, to be visible from afar.

2. A signal device according to the combination of claim 1, wherein said mailbox door has a flange that overlaps the wall structure of the mailbox when the door is closed, and wherein said tab is angled only slightly relative to the signal plate, to be extended substantially parallel to the wall structure and flange of the closed door and be fitted between said flange and wall structure, while the remainder of the signal flag is angled upwardly away from the door, and wherein the tab is held between said flange and wall structure by the upward flex of the spring on the flag plate.

3. A signal device according to the combination of claim 2, wherein said tab is of the order of between ¼ and ½ an inch long, from the main part of the flag plate, and is angled between 20 and 40 degrees from the remainder of the flag plate.

4. A signal device according to the combination of claim 1, wherein the mailbox wall structure overhangs the door when the door is closed; and wherein said tab has a hook portion angled approximately at right angles relative to the flag plate, and further has a cam portion angled at sightly less than right angles relative to the hook portion, the hook portion being fitted over an edge of the mailbox wall structure adjacent said open end after the door has been closed, and the cam portion thereupon projecting beyond the exposed side of the door to be engaged by the door upon it being opened, to disengage the hook portion from the mailbox and release the signal device automatically as the door is opened.

5. a signal device according to the combination of claim 4, wherein said tab hook portion is extended a distance between ¼ and ½ of an inch; and further wherein said cam portion is extended a distance between ½ inch and 2 inches.

6. A signal device according to the combination of claim 1, wherein further a lock nut is adapted to be threaded onto the end of one of said threaded means, to yet leave a portion that is exposed beyond the nut, that is threaded into the spring, whereupon the threaded means may be threaded to orient the flag plate at any rotational orientation relative to the base plate, and the nut may be threaded tightly to lock the plates nonrotatably together at said orientation.

7. A signal device according to the combination of claim 1, wherein further said base plate is curved along a first axis and straight along another axis at right angles to the first axis, operable to complement and be secured to a curved upper portion of the mailbox wall structure.

8. A signal device according to the combination of claim 1, wherein further said threaded means is secured to the signal plate by welding them together.

9. A signal device according to the combination of claim 1, wherein further a lip is angled from the signal plate; wherein said threaded means is a headed bolt extended through an opening in the lip, with the bolt head being on one side of the lip and a nut being threaded onto the bolt on the other side of the lip, to adjustably orient the flag plate at any rotational orientation relative to the base plate.

* * * * *